US005132742A

United States Patent [19]

Goto

[11] Patent Number: 5,132,742

[45] Date of Patent: Jul. 21, 1992

[54] IMAGE FORMING APPARATUS HAVING A SHEET RE-SUPPLY PATH

[75] Inventor: Shinji Goto, Tokyo, Japan

[73] Assignee: Canon Kabushiki Kaisha, Tokyo, Japan

[21] Appl. No.: 536,473

[22] Filed: Jun. 12, 1990

[30] Foreign Application Priority Data

Jun. 12, 1989 [JP] Japan ..... 1-148714

[51] Int. Cl.[5] ..... G03G 21/00

[52] U.S. Cl. ..... 355/319; 271/9; 271/291; 271/902; 355/24; 355/318

[58] Field of Search ..... 355/308, 309, 318, 319, 355/326, 327, 23, 24; 271/9, 291, 902

[56] References Cited

U.S. PATENT DOCUMENTS 4,774,545 9/1988 Tsuji et al. ..... 271/9 X
4,918,490 4/1990 Stemmle ..... 271/291 X
4,935,786 6/1990 Veeder ..... 355/319
4,943,832 7/1990 Emori ..... 355/319 X
4,990,965 2/1991 Kiya ..... 355/319

FOREIGN PATENT DOCUMENTS 0047655 3/1987 Japan ..... 355/318
0313172 12/1988 Japan ..... 355/318

*Primary Examiner*—A. T. Grimley
*Assistant Examiner*—William J. Royer
*Attorney, Agent, or Firm*—Fitzpatrick, Cella, Harper & Scinto

[57] ABSTRACT

The present invention provides an image forming apparatus having a sheet re-supplying path. The re-supplying path for supplying a sheet on which the image has been formed by the image forming apparatus back to the image forming apparatus. A rotatable feeding member is disposed in the sheet re-supplying path for pinching and feeding a leading end portion of a previous sheet, a second rotatable feeding member is disposed at an upstream side of the rotatable feeding member and is in the sheet re-supplying path for permitting the entrance of a next sheet in a condition that a trailing portion of the previous sheet is situated in the second rotatable feeding member, and a controller for permitting the second rotatable feeding member to feed the next sheet after the trailing end of the previous sheet fed by the rotatable feeding member has passed through the second rotatable feeding member.

8 Claims, 5 Drawing Sheets

IMAGE FORMING APPARATUS HAVING A SHEET RE-SUPPLY PATH

BACKGROUND OF THE INVENTION

1. Field of the Invention

The present invention relates to an image forming apparatus having a sheet re-supplying path for forming at least two images on the same sheet.

2. Related Background Art

Recently, image forming apparatuses in which images are formed on both surfaces of a single sheet have been requested more and more. Among these apparatuses, there is, for example, a laser beam printer (LBP) 1*d* as shown in FIG. 1.

In FIG. 1, the laser beam printer 1*d* includes a body 2 having a bottom on which a cassette 3 accommodating sheets S is disposed. A sheet supply roller 5 is arranged above the front part of the cassette 3 to separate and supply the sheets one by one. At a downstream side of the supply roller 5, there are arranged, in order, a pair of regist rollers 6 for maintaining a leading end of the sheet picked-up by the supply roller 5 in a correct position to ensure good recording accuracy of an image, and a process unit 10 comprising functional portions such as a photosensitive drum 7, a developing device 9 and the like.

A laser scanning unit 11 illuminates a laser beam on the photosensitive drum 7 on the basis of image information from an apparatus body (not shown) to form a latent image on the drum. The latent image is developed by the developing device 9 to form a toner image which is in turn transferred onto the sheet S fed by the supply roller 5 and pressed against the photosensitive drum 7 by a transfer roller 12. The sheet S having the transferred image thereon is fixed by a fixing device 13 including fixing rollers arranged at a downstream side of the transfer roller 12, and then is fed to a pair of feed rollers 15 and then to a downstream flapper 16.

If the image is to be printed or recorded on a single surface of the sheet S, as shown in FIG. 1, the flapper 16 is in a position rotated in an anticlockwise direction, where the sheet on which the image has been recorded is directed toward an sheet ejecting path 19 through which the sheet S is ejected onto an ejector tray 17 with a recorded surface thereof turned inside.

On the other hand, if the images are to be recorded on both surfaces of the sheet S, the flapper 16 is rotated in a clockwise direction from the position of FIG. 1 to a "both-surface" position, the sheet S is directed toward sheet guides 22 of a switch-back unit 21 and then is pinched or nipped and fed by reversible rollers 23. When a trailing end of the sheet S is detected by a sensor 25 arranged at a downstream side of the sheet guides 22, the reversible rollers 23 are rotated reversely to feed the sheet in the reverse direction. The sheet S fed in the reverse direction is directed toward a sheet feeding path 26 for a second surface recording (sheet re-supplying path) by a flapper 25 disposed at an upstream side of the reversible rollers 23, and then is fed toward re-supply rollers 29 by means of feed rollers 27 disposed in the sheet re-supplying path.

Incidentally, the flapper is spring-biased to normally occupy the position shown by a solid line in FIG. 1, and the sheet fed from the sheet guides 22 reaches the reversible rollers 23 while urging the flapper 25 downwardly. When the trailing end of the sheet has passed through the flapper 25, the latter is returned to the position shown in FIG. 1.

The sheet feeding path 26 for the second surface recording is driven independently from that of a sheet feeding path 20 for a first surface recording, since it must be controlled independently from the sheet feeding path 20. At a downstream side of the re-supply rollers 29, a sensor 30 for the second surface recording is arranged. When the sensor 30 detects the leading end of the sheet S, the sheet is stopped, whereby the timing of the sheet supply for the second surface recording is controlled.

The sheet re-supplying path 26 includes a path section 26*a* positioned between the reversible rollers 23 and the feed rollers 27, a path section 26*b* positioned between the feed rollers 27 and the re-supply rollers 29, and a path section 26*c* positioned between the re-supply rollers 29 and the regist rollers 6. Since the sheet S is switched back in the switchback unit 21, in the sheet feeding path 26 for the second surface recording, the first recorded surface of the sheet S faces toward the photosensitive drum 7; but, the sheet S is U-turned in the path section 26*c* so that the second non-recorded surface of the sheet faces the photosensitive drum 7 when the image is recorded on the sheet again.

However, in the above-mentioned conventional arrangement, there arose the following problems:

That is to say, since the image forming apparatus having the sheet re-supplying path has recently been small-sized, the sheet feeding path for the second surface recording is normally shorter than the twice of the maximum length of the sheet S to be re-supplied. As a result, when the first sheet S is waiting for the second surface recording in the sheet re-supplying path 26, the second sheet S cannot be fed to the sheet feeding path 20.

Accordingly, when the images are recorded on both surfaces of the same sheet, the recording is effected, in order, for the first surface of the first sheet, second surface of the first sheet, first surface of second sheet, second surface of the second sheet, . . . first surface of (N−1)th sheet, second surface of the (N−1)th sheet, first surface of Nth sheet, second surface of the Nth sheet, and so on. In this way, since the first surface of a new sheet cannot be recorded till after the second surface of the previous sheet has been recorded, the through-put was considerably worsened when the image were on both surfaces of the same sheet.

SUMMARY OF THE INVENTION

Therefore, an object of the present invention is to provide an image forming apparatus having a sheet re-supplying path which can store at least two sheets in a sheet feeding path for a second surface recording (sheet re-supplying path) whereby the through-put in the duplex recording is maintained as the same as that in the single-surface recording.

Under these circumstances, the present invention provides an image forming apparatus comprising, for example, an image forming means for forming an image on a sheet; a sheet re-supplying path for re-supplying the sheet having one surface on which the image has been recorded to the image forming means again; and at least two sheet stop positions (first and second sheet stop positions) situated in the sheet re-supplying path; and wherein a distance between the two sheet stop positions is selected to be smaller than a maximum length of the sheet to be fed, and at least two successive sheets (first and second sheets) stored in the sheet re-supplying path can be independently stopped in the first and second sheet stop positions and be independently fed.

With this arrangement, the sheet is fed to an image forming portion where the image is formed on the sheet. When the plural images are to be recorded on the sheet, the first sheet previously fed is fed to the first sheet stop position in the sheet re-supplying path and is stopped there. The second sheet successively fed is fed to the second sheet stop position in the sheet re-supplying path and is stopped there, partially overlapping with the first sheet.

The first and second sheets can be stopped and fed independently in the sheet re-supplying path, in spite of the fact that the distance between the first and second sheet stop positions is smaller than the maximum length of the sheet, and the first sheet is re-supplied to the image forming portion while the second sheet is stopped in the second sheet stop position. In this way, the both-surface recording o multi-recording is effected while a plurality of sheets are successively fed in the sheet re-supplying path.

According to the present invention, since the first and second sheet stop positions are provided in the sheet re-supplying path for re-supplying the sheet already printed to the image forming portion again, and since the distance between the first and second sheet stop positions is smaller than the maximum length of the sheet to be fed, the through-put in the both-surface recording or multi-recording can be maintained as the same as that in the single-surface recording while keeping the apparatus small-sized.

DESCRIPTION OF THE PREFERRED EMBODIMENTS

Figure 1:
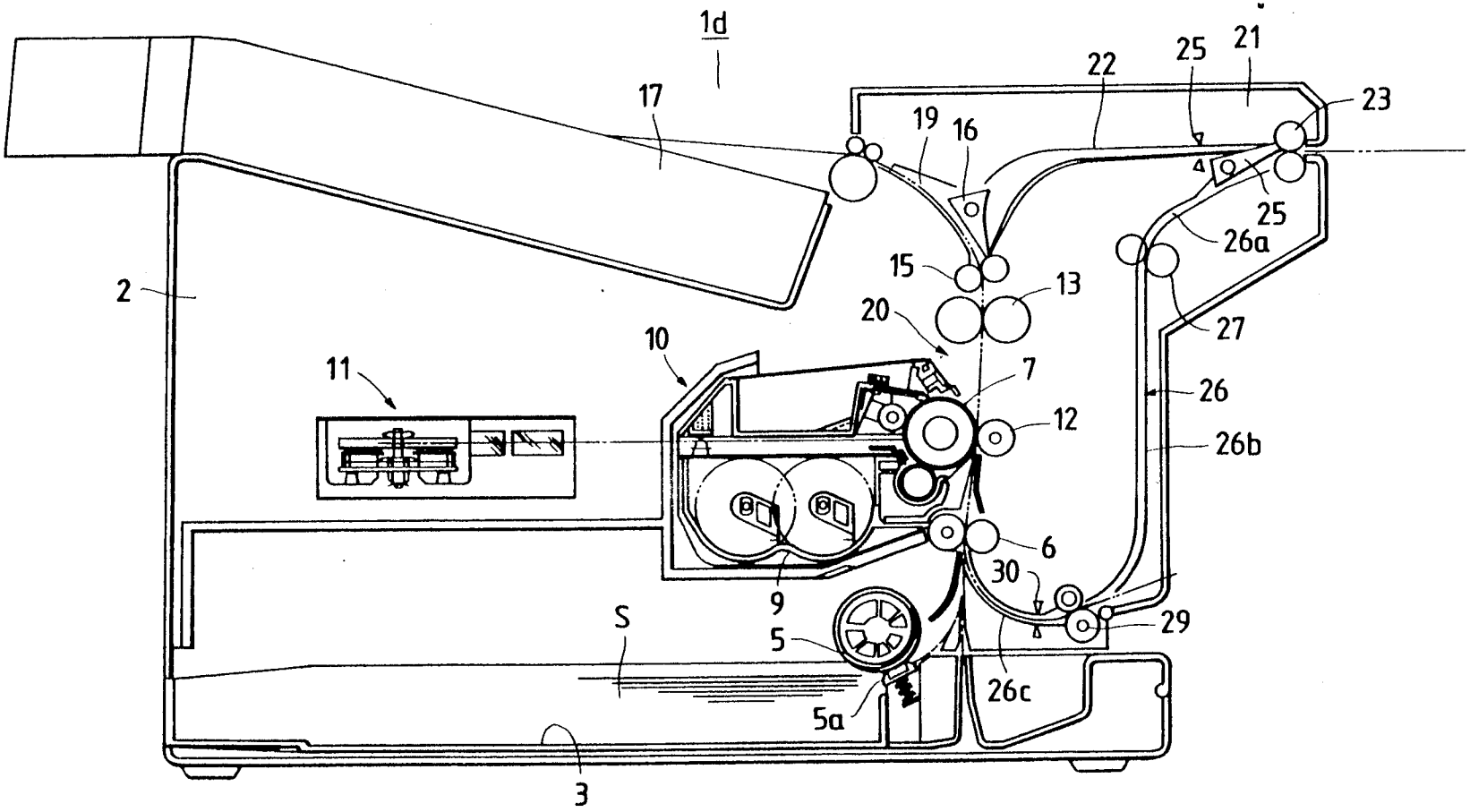
FIG. 1 PRIOR ART
FIG. 1 is an elevational sectional view of a conventional image forming apparatus having a sheet re-supplying path.

The present invention will now be explained in connection with embodiments thereof with reference to FIGS. 2 to 5. Incidentally, the same elements as shown in FIG. 1 are designated by the same reference numerals and the explanation thereof will be omitted.

Figure 2:
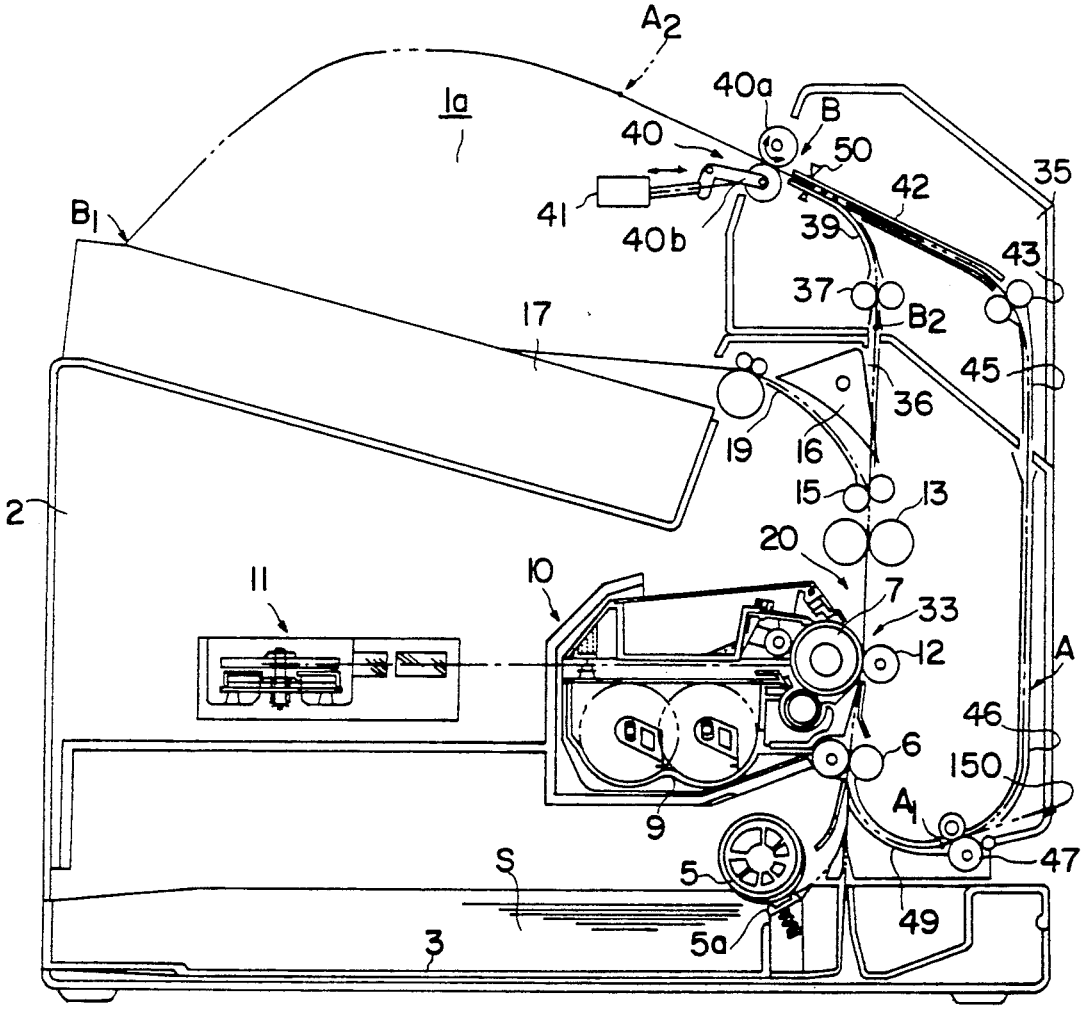
FIG. 2 is an elevational sectional view of an image forming apparatus having a sheet re-supplying path according to a preferred embodiment of the present invention.

In FIG. 2 showing an elevational sectional view of an image forming apparatus la having a sheet re-supplying path according to a first embodiment of the present invention, the image forming apparatus 1*a* such as a laser beam printer or the like includes a cassette 3 accommodating sheets S therein, which cassette 3 can be inserted into and removed from a body 2 of the apparatus from a rightward direction of FIG. 2. A separating pad 5*a* is incorporated into the front part of the cassette 3 and is formed integrally with cam members (not shown) projecting from both sides of the cassette 3. The separating pad 5*a* cooperates with cam surfaces (not shown) formed on cassette guides (not shown) of the body 2 to engage with or disengage from a sheet supply roller 5 in response to the insertion or removal of the cassette 3.

The sheets S in the cassette 3 are fed one by one by means of the supply roller 5 to a pair of regist rollers 6 (now stopped) while preventing the doublefeed of the sheets by the separating pad 5*a*. While the sheet S is being fed to the regist rollers 6, a loop is formed in the sheet, whereby a leading end of the sheet is aligned with the nip of the regist rollers to correct the skew-feed of the sheet. The sheet S is fed, by the regist rollers 6 which are rotated after the formation of the loop in the sheet, to an image forming portion 33 comprising a photosensitive drum 7 of a process unit 10 and a sheet feeding path 20, where a toner image is transferred onto the sheet. The toner image is then fixed to the sheet by a fixing device 13. If an image is recorded on a single surface of the sheet (single-surface recording), the sheet S is guided by a flapper 16 to an ejecting path 19 and is ejected onto an ejector tray 17 with a recorded surface thereof turned inside.

In an upper portion of the image forming apparatus 1*a*, a switch-back unit 35 can optionally be arranged. In order to omit the provision of useless functions on the body 2, the apparatus body 2 includes a sheet feeding path 36 for a second surface recording alone, but does not include feed rollers and the like.

In the switch-back unit 35, there are arranged first feed rollers 37 which are disposed at a downstream side of the flapper 16 and which can be stopped and rotated, and a sheet feeding path 39. At a downstream side of the sheet feeding path 39, there are arranged a pair of cooperating reversible rollers 40. The reversible rollers 40 comprise a reversible roller 40*a* driven by a driving source (not shown) and a driving roller 40*b* pressed against and driven by the roller 40*a*. The driven roller 40*b* can also be separated from the reversible roller 40*a* by means of a sheet feeding force interrupting mechanism (plunger, rinks, spring) 41.

At a downstream side of the reversible rollers 40 in case of the reverse rotation thereof (right side in FIG. 2), a shiftable lateral regist guide 42 for correcting the lateral regist of the sheet S for the second surface recording, and second sheet feed rollers 43 are disposed. Further, at a downstream side of the second feed rollers 43, there are arranged, in order, sheet feeding paths 45, 46, regist rollers 47 for the sheet for the second surface recording, and a sheet feeding path 49 a downstream end of which is disposed in the vicinity of the regist rollers 6.

When the images are to be recorded o both surfaces of the sheet (both-surface recording), the flapper 16 is rotated in a clockwise direction from a position shown in FIG. 2, where the sheet S on which the toner image has been fixed by the fixing device 13 is fed to the switch-back unit 35 by means of the feed roller pair 15. In the switch-back unit 35, the sheet S having the first surface on which the image has been recorded is fed to the reversible roller pair 40 through the first feed rollers 37. Then, the sheet S is once fed out toward the ejector tray 17 by the reversible rollers 40 when a trailing end of the sheet S is detected by a sensor 50 arranged in the vicinity of the reversible rollers 40, the reversible rollers are rotated reversely to feed the sheet S in the sheet feeding paths 45, 46 for the second surface recording.

The sheet S fed in the sheet feeding paths 45, 46 is temporarily stopped against the bothsurface recording regist rollers 47 acting also as rollers for a manual inserted sheet (the manual insert sheet is inserted from an insertion inlet 150 formed in the body 2), thereby correcting the leading end regist and skew-feed of the sheet. Thereafter, the first sheet S is further fed slightly and is stopped there for waiting a print signal for the second surface recording. In this condition, if the sheet S fed from the apparatus body 2 has the maximum length, the trailing end of the first sheet S is in a condition that it is pinched by the reversible rollers 40. A position where the first sheet S is pinched by the both-surface recording regist rollers 47 will be referred as a first sheet stop position A (the leading end of the sheet is shown by $A_1$ and the trailing end $A_2$).

More specifically, in the previously-mentioned case where the images are recorded on the both surfaces of the sheet continuously, in consideration of the time when the first sheet S used for the second surface recording positively reaches the second sheet feeding path 43 in the switch-back unit 35, the reversible rollers 40 are stopped and at the same time the driven roller 40*b* is separated from the roller 40*a* by the sheet feeding force interrupting mechanism 41.

In this condition, the second sheet S which has been fed from the cassette 3 and on which the image has been formed is fed to the reversible rollers 40 by means of the first feed rollers 37 in the switchback unit 35. In this case, since the reversible rollers 40 are separated from each other as mentioned above if these rollers are stopped, the sheet S can pass through the clearance between the rollers 40. The first feed rollers 37 are stopped after a predetermined time has been elapsed, i.e., when the trailing end of the second sheet S has passed through the sheet feeding paths 20, 36 but has not yet passed through the first feed rollers 37. A position where the trailing end of the second sheet S is pinched by the first feed rollers 37 will be referred as a second sheet stop position B (the leading end of the sheet is shown by $B_1$ and the trailing end $B_2$).

Accordingly, in the above condition, if the sheet S having the maximum length is fed, the two sheets will overlap in the vicinity of the reversible rollers 40. With the operation as mentioned above, for all sizes of the sheets, it is possible to hold two sheets in the sheet feeding system (sheet feeding path 39, lateral regist guide 42, sheet feeding paths 45, 46).

Now, when a driving system (not shown) receives a print signal for the second surface recording of the first sheet, the both-surface recording regist rollers 47 are rotated, so that the first sheet S which is now waiting in the sheet feeding paths 45, 46 is fed to the image forming portion 33 through the regist rollers 6. In the image forming portion 3, the second surface recording of the first sheet is effected, and then the first sheet is ejected on the ejector tray 17. After the trailing end of the first sheet S has passed through the reversible rollers 40, the driven rollers 40*b* is pressed against the reversible roller 40*a* again by the action of the sheet feeding force interrupting mechanism 41, thereby pinching the second sheet S.

The second sheet S so pinched is once fed toward the ejector tray 17 (left) by the normal rotation of the reversible rollers 40 when the trailing end of the second sheet is detected by the sensor 50, the second sheet S is fed in the sheet feeding paths 45, 46 through the reverse rotation of the reversible rollers 40, with the result that, as in the case of the first sheet, the second sheet is waiting for the second surface recording while being pinched by the rollers 47.

Further, when the first sheet S is ejected on the ejector tray 17, a third sheet S is fed from the cassette 3. The third sheet S is stopped while being pinched by the rollers 37, 40. Thereafter, the re-supply of the second sheet S is started by the rotation of the rollers 47.

In this way, even when the previous sheet having the first recorded surface is waiting for the print signal regarding the second surface recording in the sheet feeding paths 45, 46 for the second surface recording, it is possible to perform the first surface recording of the next sheet S. Consequently, for all sizes of the sheets, the so-called alternate sheet supply is permitted, whereby it is possible to perform the continuous both-surface recording of the sheets with substantially the same through-put as that in the case of the singlesurface recording of the sheets.

Figure 5:
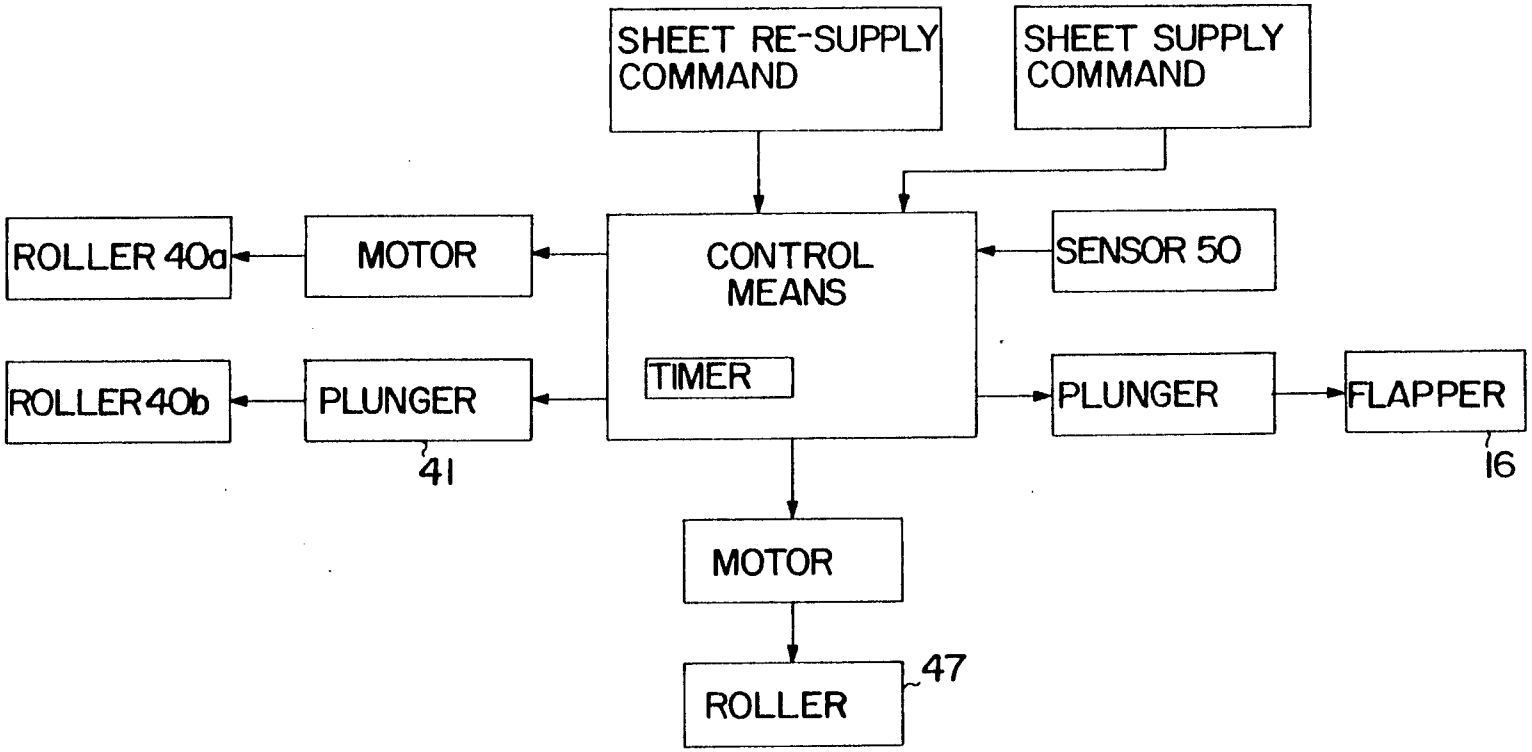
FIG. 5 is a block diagram showing control of the apparatus of FIG. 2.

FIG. 5 depicts the overall control of the apparatus of FIG. 2. In FIG. 5, the control means receives input from the sheet supply command and sheet resupply command and controls the on-off state of motors and plungers to switch the flapper 16, to rotate or stop the roller 47, to rotate the roller 40*a* normally or versely, or to cause the roller 40*b* to contact with or separate from the roller 40*a*. The sensor 50, when detecting the sheet's trailing end, controls the motors to rotate in reverse the roller 40*a* and to start the timer to thereby time the length of rotation of the roller 40*a*. Thus, the motor i switched to the OFF state when the predetermined time period has lapsed after reverse rotation of the roller 40*a*.

Figure 3:
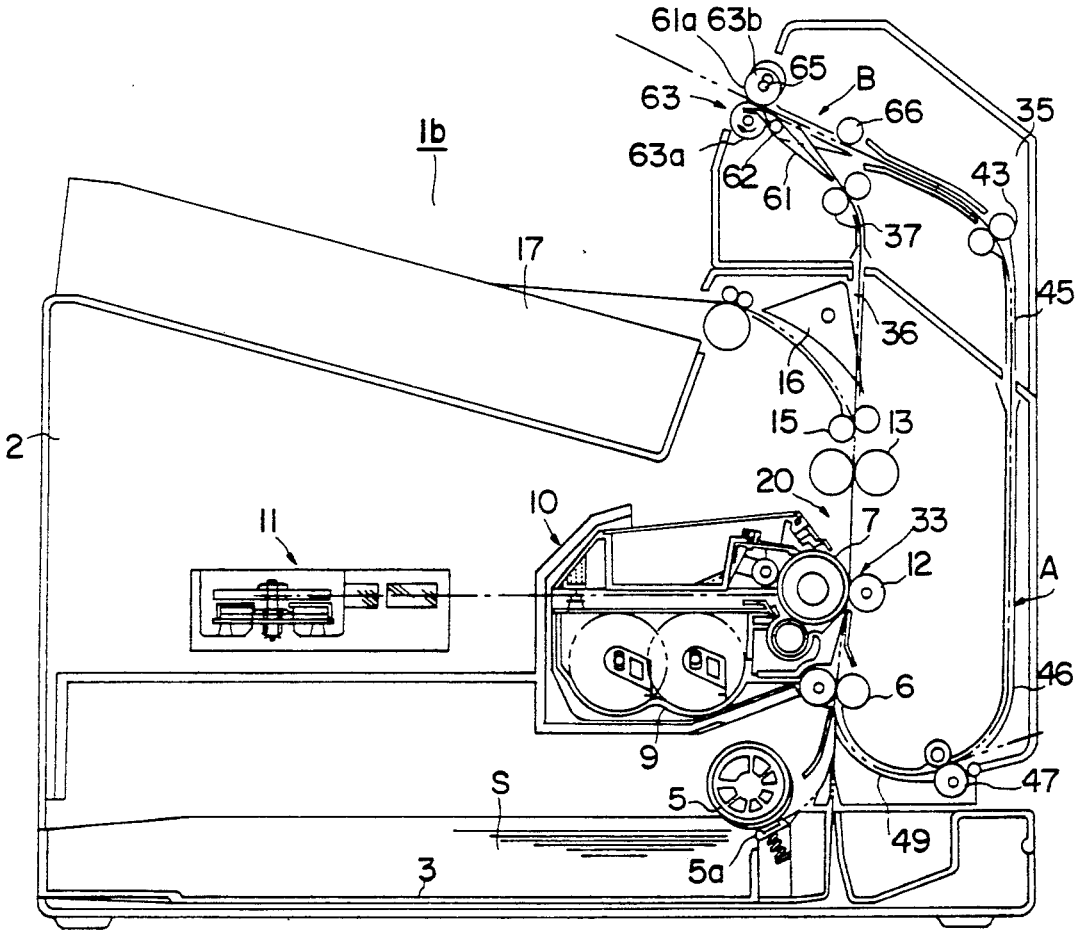
FIG. 3 is an elevational sectional view of an image forming apparatus having a sheet re-supplying path according to a second embodiment of the present invention.

FIG. 3 shows an elevational sectional view of an image forming apparatus having a sheet re-supplying path according to a second embodiment of the present invention. Incidentally, the same elements as shown in FIG. 2 are designated by the same reference numerals and the explanation thereof will be omitted.

In FIG. 3, a flapper 61 is arranged at a downstream side of the first feed rollers 37, which flapper is rotatably supported by a pin 62. The flapper 61 is so designed that when a solenoid (not shown) is energized the flapper is rotated to a position shown by a solid line in FIG. 3 and when the solenoid is de-energized the flapper is rotated to a position shown by a two-dot and chain line in FIG. 3. At a downstream side of the flapper 61, there are arranged a pair of cooperating rollers 63 which comprise a feeding roller 63*a* tending to feed the sheet S in a direction shown by the arrow, i.e., in the right direction of FIG. 3 and a driven roller 63*b* biased to be pressed against the feeding roller by means of a spring (not shown).

A cam surface 61*a* is integrally formed on the left end (FIG. 3) of the flapper 61. When the flapper 61 is rotated in the position shown in FIG. 3 through the energization of a solenoid (not shown), the cam surface 61*a* is engaged by a shaft 65 of the driven roller 63*b* to lift the latter thereby separating the driven roller 63*b* from the feeding roller 63*a*. On the other hand, when the flapper 61 is in the position shown by the two-dot and chain line in FIG. 3, the cam surface 61*a* is disengaged from the shaft 65, thereby allowing the driven roller 63*b* to be pressed against the feeding roller 63*a* by the force of the spring (not shown).

Next, an operation of the continuous bothsurface recording of the sheets using the apparatus of FIG. 3 will be explained.

In the switch-back unit 35, the first sheet S being fed by the first feed rollers 37 is guided by the flapper 61 positioned in the illustrated position by the energization of the solenoid (not shown) and then passes through a space between the feeding roller 63*a* and the driven roller 63*b* separated from the feeding roller. The first sheet S is then pinched and held by the first feed rollers 37 which are stopped immediately before the trailing end of the first sheet S passes through the rollers 37. In this case, the feeding roller 63*a* is maintained in the stopped condition.

In order to feed the sheet S to the sheet feeding paths 45, 46 for the second-surface recording, when a predetermined time is elapsed after the sheet has been fed, the solenoid connected to the flapper 61 is disenergized to rotate the flapper 61 to the position shown by the two-dot and chain line, with the result that the trailing end portion of the sheet is lifted by the flapper 61 to be pressed against the roller 66. In response to the rotation of the flapper 61, the driven roller 63*b* is pressed against the feeding roller 63*a*, thus pinching the sheet S therebetween. In this condition, by rotating the pair of cooperating rollers 63, the sheet S is fed to the sheet feeding paths 45, 46 while being guided by the flapper 61.

One-way clutches may be provided between the first feed rollers 37 and shafts (not shown) supporting the first feed rollers, so that, when the sheet S pinched by the first feed rollers 37 is drawn out, the first feed rollers 37 can be freely rotated on the corresponding shafts, whereby the operation that the sheet S is drawn out of the nip between the first feed rollers 37 and is pressed against the roller 66 upon the rotation of the flapper 61 toward the two-dot and chain position can be performed smoothly.

Thus, like in the first embodiment, by providing two sheet stop positions, one of which is the first sheet stop position A where the sheet S is held by the both-surface recording regist rollers 47 and the other of which is the second sheet stop position B where the sheet S is held by the first feed rollers 37 of the switch-back unit 35, it is possible to store two sheets in the sheet feeding paths 39, 45, 46 for the both-surface recording. Consequently, it is possible to perform the so-called alternate sheet supply in the laser beam printer lb shown in FIG. 3, whereby the through-put in the both-surface recording can be substantially the same as in the single-surface recording. In the above-mentioned second embodiment, it is not needed to rotate the feeding roller 63*a* reversibly as in the case of the first embodiment and to provide the solenoid for engaging or disengaging the driven roller 63*a* with respect to the feeding roller 63*a*.

Figure 4:
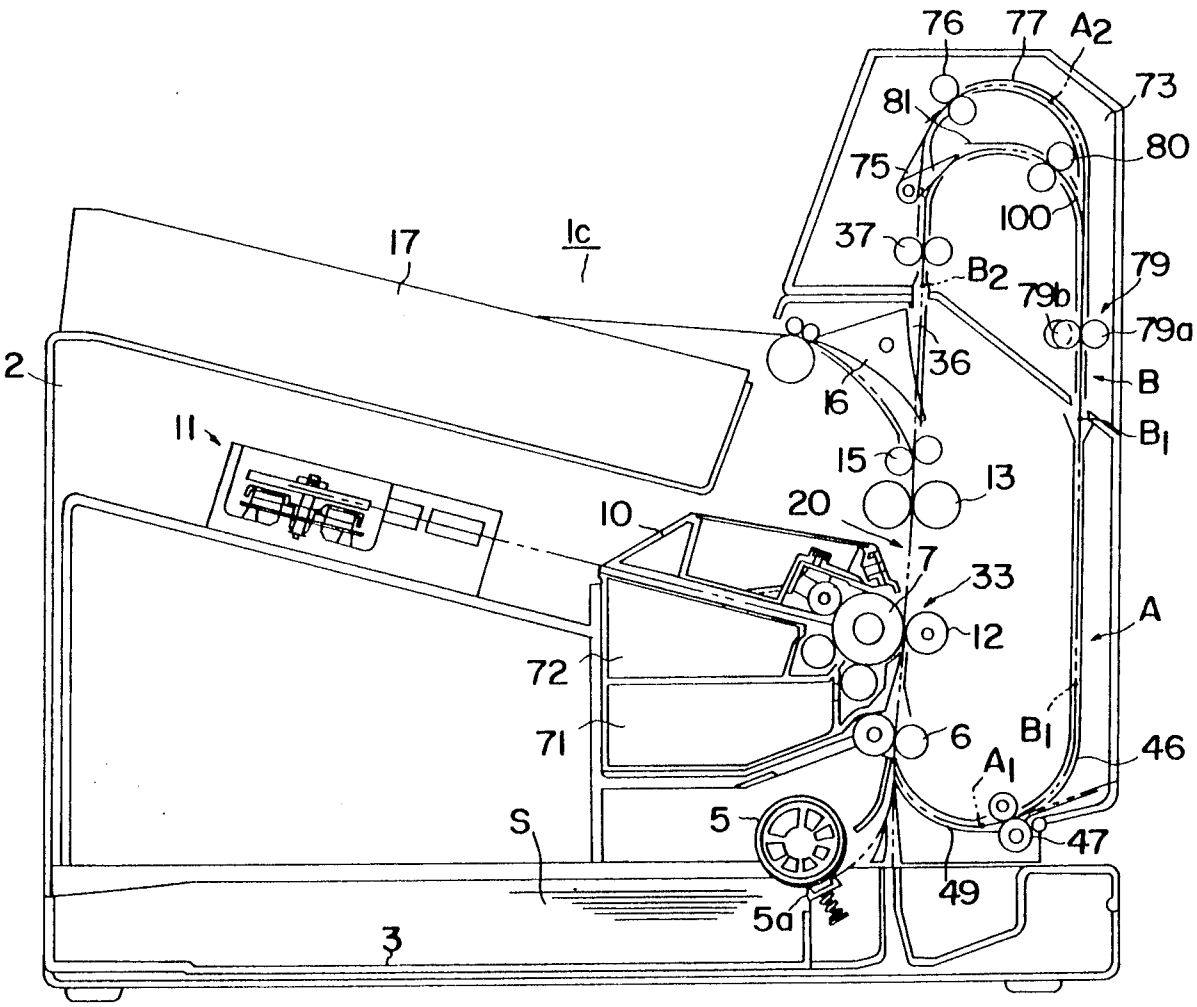
FIG. 4 is an elevational sectional view of an image forming apparatus having a sheet re-supplying path according to a third embodiment of the present invention.

FIG. 4 shows an elevational sectional view of a laser beam printer (image forming apparatus) 1*c* according to a third embodiment of the present invention. In this embodiment the present invention is applied to a printer which can record or print an image with two or more colors (multi-printing). The elements same as those shown in FIG. 2 are designated by the same reference numerals and the explanation thereof will be omitted.

In FIG. 4, a process unit 10 includes a first developing device 71 accommodating black toner, and a second developing device 72 accommodating black toner or colored toner other than black. The first and second developing devices 71 and 72 can be alternately selected in response to an image-signal from the apparatus body (not shown) to develop the image with the toner accommodated therein.

In a normal recording operation, a toner image developed by either first or second developing device 71 or 72 is transferred onto a sheet S fed by a supply roller 5. After the transferred image has been fixed to the sheet by a fixing device 13, the sheet S is ejected onto a ejector tray 17.

When the recording with plural colors is effected, the sheet S onto which the toner image developed by either first or second developing device 71 or 72 has been transferred is fed from the fixing device 13 to a flapper 16, by which the sheet is fed to a U-turn unit 73. The sheet S is then U-turned by this unit 73 and is fed to an image forming portion 33 again, where the toner image developed by the second or first developing device 72 or 71 is transferred onto the sheet S. Then, the transferred image is fixed to the sheet by the fixing device 13. In this way, the two-color recording is effected on the same sheet. Thereafter, the sheet is ejected on the ejector tray 17.

In the U-turn unit 73, a flapper 75 for switching paths for the sheet S and a first U-turn path 77 having second feed rollers 76 are disposed at a downstream side of first feed rollers 37. The second feed rollers 76 are arranged in an upstream end portion of the path 77. At a downstream side of the U-turn path 77, there are arranged a fourth pair of cooperating rollers 79 which comprises a feeding roller 79*a* connected to a driving system (not shown) and a driven roller 79*b* detachably biased against the feeding roller 79*a*. Further, a second U-turn path 81 is provided, which path 81 is branched from the first U-turn path by the flapper 75 and has third feed rollers 80 therein. A downstream end of the second U-turn path 81 is joined to the first U-turn path 77.

Next, an operation of the sheet S in the recording with two colors will be explained.

First of all, the first sheet S on which the image has been recorded with a first color is guided toward the U-turn unit 73 by means of the flapper 16, and is passed through the first feed rollers 37 to reach the flapper 75 in the U-turn unit 73. The sheet is then guided by the flapper 75 to be directed to the first U-turn path 77. Further, the first sheet S is guided by the feed rollers 76 toward the fourth roller pair 79 and the sheet feeding path 46 for the two-color recording, where the leading end regist and skew-feed of the sheet is corrected by regist rollers 47 for the two-color recording. Then, the sheet is waiting for a signal for the two-color recording.

In this condition, the trailing end $A_2$ of the first sheet S is set to be positioned in an area upstream side of the joining point 100 (between the U-turn paths 77, 81) upstream side of the nip between the feeding roller 79*a* and the driven roller 79*b* of the roller pair 79. In addition, the driven roller 79*b* is retarded to a position shown by a two-dot and chain line in FIG. 4 to be separated from the feeding roller 79*a*. Incidentally, the engagement and disengagement of the driven roller 79*b* with respect to the feeding roller 79*a* can be performed by a plunger or the like.

In the condition that the sheet S is waiting at the regist rollers 47 for the two-color recording, when the next second sheet S which has been recorded with the first color is fed to the U-turn unit 73, the flapper 75 is rotated to the position shown by the two-dot and chain line to guide the second sheet S to the second U-turn path 81. The second sheet S is guided by the third feed rollers 80 while contacting on the surface of the first sheet to be passed through a space between the separated driven roller 79b and the stopped feeding roller 79a, and is stopped in a position where the leading end $B_1$ of the second sheet enters slightly into the sheet feeding path 46 for the two-color recording.

Accordingly, in this condition, the first sheet S (i.e., the sheet which is waiting at the upstream side) is ready for being fed by the regist rollers 47 for the two-color recording, and the second sheet S (i.e., the sheet situated at the downstream side) can be fed to the regist rollers 47 by means of the feeding roller 79a which is rotated at a predetermined timing (i.e., after the trailing end of the previous sheet has passed through this roller 79a) and the driven roller 79b pressed against the feeding roller.

Therefore, since it is possible to hold two sheets S in the sheet feeding paths 47, 77 for the two-color recording, two successive recording with two colors can be permitted without worsening the through-put.

Next, a fourth embodiment will be explained in connection with FIG. 2. In the first embodiment shown in FIG. 2, while an example that the driven roller 40b can be separated from the feeding roller 40a was explained, since the purpose of the present invention is to hold and/or feed two sheets independently from each other, it is not necessary to separate the driven roller 40b from the feeding roller 40a. For example, a so-called torque limiter mechanism for interrupting the transmission of the driving force when either the reversible roller 40a or 40b is subjected to a predetermined torque or more may be provided regarding the reversible roller pair 40.

More specifically, when a pressing force between the engaged reversible rollers 40a and 40b is $F_1$, the coefficient of friction between the sheets is $\mu_1$, the coefficient between the sheet S and the reversible roller 40a is $\mu_2$, a feeding force of the reversible roller 40a when the torque limiter member (not shown) is operated is $F_2$, and a sheet feeding force of the downstream both-surface recording regist rollers 47 is $F_3$, each of the elements may be selected to give the following relationship:

$$F_3 > F_{2\mu 2} > F_1 > F_{2\mu 1}.$$

With this arrangement, if two sheets are positioned between the reversible roller 40a and the driven roller 40b, the next (second) sheet S is fed or stopped in response to the movement of the driven roller 40b. The previous (first) sheet S is not moved if one end thereof is held by other rollers (for example, rollers 43).

On the other hand, if a single sheet S is pinched between the reversible roller 40a and the driven roller 40b, when one end of the sheet is held by other rollers, the sheet is moved in response to the movement of said other rollers, otherwise, the sheet is moved in response to the movement of the reversible rollers 40a, 40b. Accordingly, while the previous sheet S is waiting in the sheet feeding paths 45, 46 for the both-surface recording and in the lateral guide 42 and this sheet is positioned between the second feed rollers 43, when the timing that the next sheet S is fed between the pair of reversible rollers 40 is reached, the pair of reversible rollers 40 tend to rotate to feed the sheet S to the left (FIG. 2). In this case, if the next sheet S has not yet been entered between the pair of reversible rollers 40, the previous sheet S is not moved to the left, since it is held by the first feed rollers 37. That is to say, the torque limiter mechanism is operated to interrupt the transmission of the driving force to the reversible roller 40a whereby the pair o reversible rollers 40 remain stationary or are rotated freely.

On the other hand, when the next sheet S is entered between the pair of reversible rollers 40, the driven roller 40b feeds only the next sheet to the left (FIG. 2) by a distance substantially corresponding to the length of the sheet S are then is stopped. In this condition, the both-surface recording regist rollers 47 start to rotate to feed the previous sheet S waiting in the sheet feeding path 46. In this case, among the two sheets pinched between the reversible rollers 40, only the previous sheet S is fed, and the next sheet S remains stationary since it is held by the stopped driven roller 40b.

Accordingly, with the arrangement as mentioned above, it is possible to hold and feed two sheets independently in the switch-back unit 35. The torque limiter mechanism disposed between the reversible rollers 40 and supporting shafts therefor may comprise a torque limiter member utilizing the friction, or other members, for example, a member capable of interrupting the transmission of the driving force to the reversible roller 40a when either one of the paired reversible rollers 40 is subjected to a predetermined load or more.

Further, the lower roller 40b may be a driving roller, and the upper roller 40a may be a driven roller.

What is claimed is:

1. An image forming apparatus having a sheet re-supplying path, comprising:

an image forming means for forming an image on a sheet;

a sheet re-supplying path for supplying a sheet on which the image has been formed by said image forming means to said image forming means again;

a rotatable feeding means disposed in said sheet re-supplying path, for pinching and feeding a leading end portion of a previous sheet:

a second rotatable feeding means disposed at an upstream side of said rotatable feeding means in said sheet re-supplying path, for entry and feeding a next sheet in a condition that a trailing portion of said previous sheet is situated in said second rotatable feeding means; and a control means for permitting said second rotatable feeding means to feed said next sheet after the trailing end of said previous sheet fed by said rotatable feeding means has passed through said second rotatable feeding means.

2. An image forming apparatus according to claim 1, further having an ejecting path for directing a sheet on which the image has been formed to an ejector tray, and a flapper for directing the sheet to said ejecting path or to said sheet re-supplying path

3. An image forming apparatus according to claim 2, wherein said sheet re-supplying path includes a switch-back path for reversing a sheet feeding direction, and said second rotatable feeding means is disposed in said switch-back path.

4. An image forming apparatus according to claim 3, wherein said second rotatable feeding means comprises a pair of rotatable rollers, said pair of rollers being engageable by and separable from each other, and wherein said pair of rollers are separated from each other when said next sheet is being fed, and are engaged by each other when they feed said next sheet.

5. An image forming apparatus according to claim 3, wherein said second rotatable feeding means comprises a pair of cooperating rotatable rollers, and further including a torque limiter mechanism for interrupting the transmission of a feeding force to one of said cooperating rotatable rollers when at least one of said cooperating rotatable rollers is subjected to a predetermined torque or more.

6. An image forming apparatus according to claim 2, wherein said sheet re-supplying path comprises a first U-turn path for directing the sheet on which the image has been formed to said second rotatable feeding means, and a second U-turn path for directing the sheet to said second rotatable feeding means through another route, and said second rotatable feeding means is arranged at a downstream side of a joining point between said first U-turn and said second U-turn pass.

7. An image forming apparatus according to claim 6, wherein said previous sheet is directed to said second rotatable feeding means through said first U-turn path and then is stopped, and said next sheet is directed to said second rotatable feeding means through said second U-turn path and then is stopped.

8. An image forming apparatus according to claim 1, wherein said sheet re-supplying path can be optionally provided.

* * * * *

UNITED STATES PATENT AND TRADEMARK OFFICE

CERTIFICATE OF CORRECTION

PATENT NO. : 5,132,742

DATED : July 21, 1992

INVENTOR(S) : Shinji GOTO

It is certified that error appears in the above-identified patent and that said Letters Patent is hereby corrected as shown below:

COLUMN 1

Line 45, "an" should read --a--.

COLUMN 4

Line 56, "recorded o" should read --recorded on--.

COLUMN 5 line 53, "bothsurface" should read --both-surface--.

COLUMN 6

Line 20, "singlesurface" should read --single-surface--.
Line 27, "versely," should read --reversely,--.
Line 33, "motor i" should read --motor is--.

COLUMN 7

Line 1, "bothsurface" should read --both-surface--.
Line 58, "embodiment" should read --embodiment,--.

UNITED STATES PATENT AND TRADEMARK OFFICE

CERTIFICATE OF CORRECTION

PATENT NO. : 5,132,742

DATED : July 21, 1992

INVENTOR(S) : Shinji GOTO

It is certified that error appears in the above-identified patent and that said Letters Patent is hereby corrected as shown below:

COLUMN 10

Line 7, "are" should read --and--.

COLUMN 12

Line 2, "pass." should read --path.--.

Signed and Sealed this

Sixteenth Day of November, 1993

Bruce Lehman

*Attest:*

BRUCE LEHMAN

*Attesting Officer*

*Commissioner of Patents and Trademarks*